United States Patent [19]

Mayerjak

[11] 4,304,168

[45] Dec. 8, 1981

[54] KEY BED FOR A PIANO OR THE LIKE

[75] Inventor: Robert J. Mayerjak, Torrington, Conn.

[73] Assignee: Currier Piano Company, Inc., Marion, N.C.

[21] Appl. No.: 77,150

[22] Filed: Sep. 19, 1979

[51] Int. Cl.[3] ..... G10C 3/02

[52] U.S. Cl. ..... 84/430; 84/177

[58] Field of Search ..... 84/177, 184–186, 84/193, 250, 352, 430–434, 452, 174, 423

[56] References Cited

U.S. PATENT DOCUMENTS

| | | | |
|---|---|---|---|
| 1,618,521 | 2/1927 | Eilert | 84/186 |
| 2,191,443 | 2/1940 | Day et al. | 84/174 |
| 2,230,928 | 2/1941 | Brasted | 84/174 |
| 3,477,330 | 11/1969 | Bert | 84/193 |
| 3,774,493 | 11/1973 | Yamada | 84/423 |

*Primary Examiner*—Lawrence R. Franklin

*Attorney, Agent, or Firm*—McCormick, Paulding & Huber

[57] ABSTRACT

A key bed for a piano or the like is comprised by a laminated structure having two outer layers of sheet steel and an intermediate layer of a wood product. The steel layers are bonded to the intermediate layer, and the intermediate layer is substantially thicker than the outer layers of steel to offset the outer layers from one another and thereby increase the stiffness of the key bed.

10 Claims, 3 Drawing Figures

KEY BED FOR A PIANO OR THE LIKE

BACKGROUND OF THE INVENTION

The present invention relates to pianos, organs, harpsichords and the like which include a keyboard by which the instrument is played. In particular, the invention is concerned with the key bed which underlies the keyboard and supports the keys within the structural frame of the instrument.

The key bed in pianos and the like plays several important roles in the instrument frame. It is a structural member which extends between the arms of the frame at the front of the piano and also provides a level platform on which the keys, their hinges and stops and associated portions of the piano action are supported. In the past it has been customary to construct the key bed of laminated hardwoods which are sealed to resist moisture and protect against warpage. Since the bed supports the keys, any warpage of the bed displaces the keys and can interfere with the regulation that establishes identical function and timing of the keys, their associated actions and the strings. The warpage may totally prevent operation of the individual keys but even slight malfunctions may cause the response to depression of the keys to be so significantly degraded that satisfactory performance is impossible. Increased pressures, sticking keys, lost motion, or slow return of the keys and lifting of the dampers significantly interferes with the touch or feel of the piano or affects the sound produced by the strings.

In spite of the precautions taken to prevent warpage of the key bed, problems can arise which require repair or replacement of the key bed. Such repairs are costly and time consuming due to the extensive disassembly and reassembly process required to reach and work on the key bed in the underlying structure of the piano.

It is accordingly a general object of the present invention to provide an improved key bed for the keyboard of a piano or the like and which is economical to produce and has a high stiffness to resist warpage and distortion.

SUMMARY OF THE INVENTION

The present invention resides in a key bed underlying and supporting the keyboard of a piano or the like. The bed is comprised of a laminated, composite structure having an upper layer of sheet metal, a lower layer of sheet metal and an intermediate material holding the sheet metal layers in spaced and parallel relationship.

In one form of the invention, the sheet metal is steel and the material separating the metal is a reconstituted wood product such as particleboard or fiberboard. The sheet metal layers are bonded to the intermediate material so that the metal layers are spaced from one another and most effectively add stiffness to the laminated structure through the high modulus of the metal.

DESCRIPTION OF THE PREFERRED EMBODIMENTS

Figure 1:
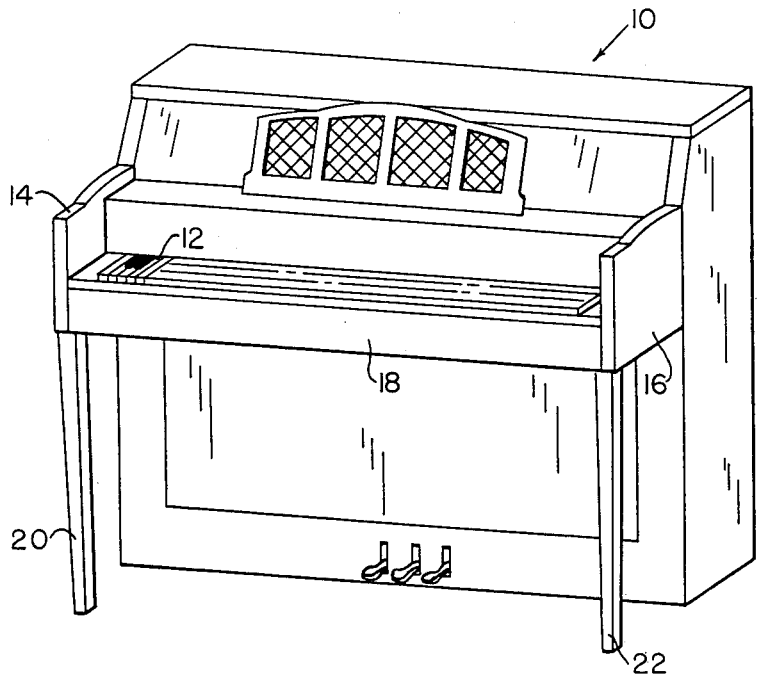
FIG. 1 is a perspective view of a piano in which the present invention is incorporated.

FIG. 1 illustrates a piano in which the structural platform or key bed of the present invention is installed. The piano, generally designated 10, is conventional and includes a key board having a plurality of keys 12 supported between the piano arms 14 and 16. The key bed is not visible in FIG. 1 since it is covered by the keys 12 on top, the key slip 18 at the front and the arms 14 and 16 at each side.

Figure 2:
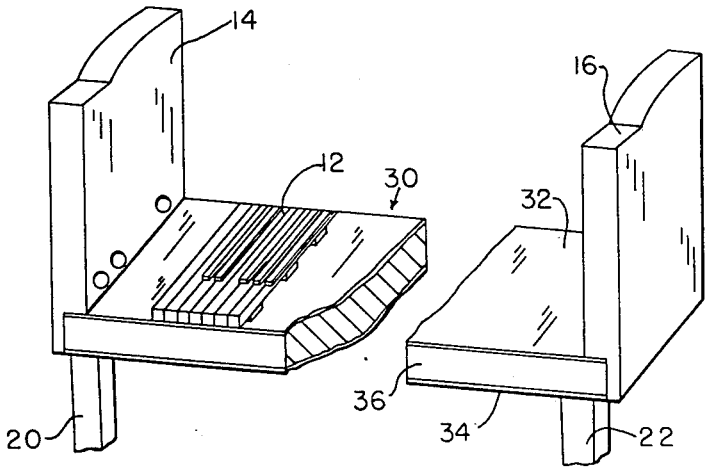
FIG. 2 is a perspective view of the key bed mounted between the two side arms of the piano frame and broken away at the mid portion to illustrate the laminated construction.

In FIG. 2 the surrounding portions of the piano have been removed in order to illustrate the key bed 30 of the present invention. As a structural portion of the piano frame or case the key bed interconnects the arms 14 and 16, provides a mount for the legs 20 and 22 and supports the keyboard. The bed 30 is connected structurally with the arms 14 and 16 at each side of the piano as shown in detail in FIG. 3, and is connected with the legs 20 and 22 at the lower surface of the bed. The keyboard including the keys 12, portions of which are shown in FIG. 2, extends over the upper surface of the bed 30 and is attached to the bed for positioning and alignment. Since the bed forms the structural foundation for the keyboard, the keyboard assumes the same level condition as the bed, and if the bed should happen to warp or otherwise become distorted, the keyboard becomes distorted in the same fashion. It is for this reason that the stiffness and integrity of the key bed are important.

Figure 3:
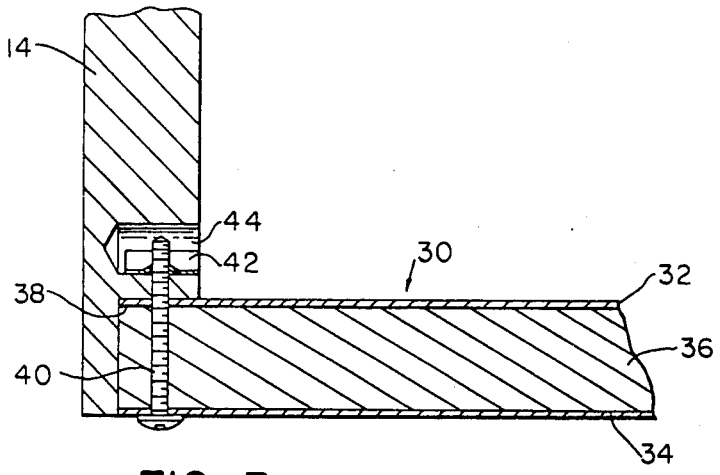
FIG. 3 is a fragmentary cross-sectional view showing the laminated key bed joined to the side arm of the piano frame.

In accordance with the present invention, the key bed 30 shown in FIGS. 2 and 3 is a laminated, composite structure comprised by an upper layer 32 of sheet metal, a lower layer 34 also of sheet metal and an intermediate layer which holds the sheet metal layers in spaced and parallel relationship with one another. The material from which the intermediate layer is formed may be a reconstituted wood product such as particleboard or fiberboard, which is economically competitive with laminated wood boards.

The reconstituted material is basically a wood product which has been reduced to small size and then reassembled in a panel. The panel or board materials retain some of the properties of wood but because of other materials and processes used in their manufacture, the resulting product has new and different properties as well.

The manufacturing processes by which the wood products are made either convert the wood into fibers which are then interfelted to bring the fibers together again as a structural panel, or the wood is mechanically broken down into discrete particles which are then reassembled with synthetic adhesives or other suitable binders and pressed or extruded into a structural panel. The panels comprised by interfelted fibers are commonly referred to as fiberboard while the panels formed by discrete particles are referred to as particleboard. For a more complete explanation of such reconstituted products, reference may be had to Agricultural Handbook No. 72 by the Forest Products Laboratory, Forest Service, U.S. Department of Agriculture and entitled Wood Handbook: Wood as an engineering material, Rev. August 1974.

In the embodiment of the invention described hereinafter, the intermediate layer 36 is assumed to be a fiberboard such as the type manufactured under the trade name Baraboard.

The laminated construction of the key bed 30 places the sheet metal layers in spaced relationship to provide both longitudinal and crosswise stiffness. Insofar as stiffness or bending is concerned, the fiberboard layer 36 itself is relatively weak, but holds the sheet metal as far from the central plane of the bed, and correspondingly the neutral bending axis, as possible within the dimensions of the laminated structure. Through this positioning greatest benefit is derived from the higher Young's modulus of the sheet metal. For example, the layers 32 and 34 in one embodiment of the invention are sheet steel which has a modulus of $30\times10^6$ psi, compared to the modulus of $0.5\times10^6$ psi for the above referenced fiberboard. The remote positioning of the sheet metal laminates makes the key bed 30 quite rigid even though the fiberboard layer 36 of lower modulus is much thicker than the metal and occupies a substantial portion of the bed volume.

A key bed of high rigidity is particularly advantageous because it minimizes the distortions that occur elsewhere in the piano frame due to moisture, stresses associated with moving or uneven support and other disturbances that interfere with the proper regulation of the keys and action. Critical settings or distances that can be affected include key height and dip, blow and letoff clearances, after-touch and damper regulations. In addition to interfering with the settings and clearances of the keys and action, the warpage may also introduce undesired friction or lost motion for one or more keys. Proper regulation for each of the keys and the actions associated with each key must be maintained, otherwise the performance of the piano or individual keys or sections of the keyboard may be degraded to such an extent that particular notes can not even be played. Even minor maladjustments which interfere with the sound level or the rate at which a particular note may be played can preclude the playing of some musical works. Therefore, the improved stiffness without additional cost of the laminated key bed 30 offers a significant advantage in piano construction.

In one embodiment of the laminated key bed 30, each of the outer layers 32 and 34 is formed by sheet steel which is 0.032 inches in thickness. The intermediate layer of fiberboard is 1.5 inches in thickness and the sheet metal is bonded to the upper and lower surfaces of the fiberboard. An epoxy resin is utilized as the bonding agent and the bonding process takes place with the application of pressure normal to the laminates and at room temperature suitable for curing the particular resin being used. The entire laminated structure is then coated with a suitable sealer to prevent moisture from penetrating into the fiberboard layer 36. Acrylic resins may also be used, and the application of heat in conjunction with pressure may be desirable to speed up or promote setting of the resin.

The laminated key bed 30 with the outer layers of sheet metal is more resistant to moisture-induced distortion than the prior art laminated wood beds due to the insensitivity of the sheet metal to moisture and the large surface area of the bed which is covered by the metal. The edges of the bed which are not covered are readily closed to moisture with conventional sealers so that the entire bed will remain level or flat during its lifetime.

The laminated key bed 30 with the outer layers of sheet metal is easily joined with the other frame members of the piano because the sheet metal provides a hard flat surface against which the other frame members are seated, and the sheet metal can absorb local stresses from screws and other fastening components. FIG. 3, for example, illustrates an assembly of the bed 30 and the side arm 14 as claimed and described in greater detail in my copending application Ser. No. 77,851 filed Sept. 21, 1979 and entitled Arm And Key Bed Assembly For A Piano And The Like. The lower portion of the arm 14 has a rabbet defining a seating surface that confronts the upper sheet metal layer 32. Pressure is applied to the seat to hold the arm and bed in angular relationship by mean of a plurality of sheet metal screws 40 which extend upwardly through the lower metal layer 34, the intermediate layer 36 and the upper layer 32 into a barrel nut located within a drilled access port 44. If desired a washer may be provided under the head of the screw 40 for wider distribution of the clamping stresses that hold the arm and bed together.

With the joint between the arm and bed formed as illustrated in FIG. 3, the high shear strength of the sheet metal laminates compensates for the relative weakness of wood, fiberboard or particleboard to shear loads which tend to pull the key bed away from the arm. In effect, the screw 40 which resists such loads distributes the loads and associated stresses in the sheet metal layers and into the fiberboard along the expansive surfaces of the fiberboard to which the metal is bonded. Overall, a secure assembly of the piano frame is obtained.

While the present invention has been described in a preferred embodiment it should be understood that numerous modifications and substitutions can be made without departing from the spirit of the invention. For example, the specific dimensions referred to above are not limiting and can be varied to meet the particular demands of any given key bed and piano frame. Metals other than steel may be employed for the outer laminates but steel is preferred due to the high Young's modulus and availability of the metal in various thicknesses. It is important that the outer layers of high modulus material be spaced from each other to obtain high stiffness in the key bed. Consequently, the material forming the intermediate layer or several intermediate layers may have a low bending strength but is substantially thicker than the sheet metal layers to provide the desired separation. The intermediate material may be made from low modulus materials other than reconstituted wood products. Such other materials may include, rigid foams, for example a polyurethane foam, now used in some furniture structures. Other light-weight filler or core materials such as paper or metal honeycombs can also be used as the intermediate material. Accordingly the present invention has been described above in several embodiments by way of illustration rather than limitation.

I claim:

1. In a piano or like instrument having a keyboard containing a plurality of keys by which the instrument is played, an improved key bed underlying and supporting the keys to provide a firm and level platform for the keys comprising:

a laminated, composite structure having an upper layer of metal, a lower layer of metal and intermediate material interconnecting and holding the sheet metal layers in spaced and generally parallel relationship.

2. An improved key bed in a piano or the like as defined in claim 1 wherein the intermediate material has a Young's modulus relatively small compared to the modulus of the metal.

3. An improved key bed as defined in claim 1 or 2 wherein the intermediate material has a thickness between the metal layers substantially greater than the thickness of the metal layers.

4. An improved key bed as defined in claim 1 wherein the intermediate material is comprised by a reconstituted wood product.

5. An improved key bed in a piano or the like as defined in claim 1 wherein the intermediate material is a structural material forming an intermediate laminate; and the upper and lower layers of sheet metal are bonded to the upper and lower surfaces of the intermediate layer respectively.

6. An improved key bed as defined in claim 1 wherein the intermediate material is comprised by a rigid foam.

7. An improved key bed as defined in claim 1 wherein the intermediate material is comprised by a honeycomb core material.

8. An improved key bed as defined in claim 1 wherein the upper and lower layers of metal are sheet metal.

9. An improved key bed as described in claim 8 wherein the upper and lower layers of sheet metal are steel sheet.

10. In an improved piano or the like, a key bed providing a warpage-resisting and non-flexing platform to support the keys comprising:

a laminated structure having an upper outer layer of steel in sheet form, a lower outer layer of steel in sheet form, and an intermediate layer of a wood product, the intermediate layer being bonded to the layers of steel in sheet form and having substantially greater thickness than the thickness of the layers of steel to offset the outer layers of steel from one another and increase the stiffness of the bed.

* * * * *